United States Patent [19]

Louden et al.

[11] Patent Number: 4,500,607

[45] Date of Patent: Feb. 19, 1985

[54] FLAT PAPER AND METHOD OF MANUFACTURING INVOLVING CONTROLLED DRYING CONDITIONS

[75] Inventors: William G. Louden, c/o Louden and Company, Erwinna, Pa. 18920; William S. Louden, Erwinna, Pa.

[73] Assignee: William Gordon Louden, Erwinna, Pa.

[21] Appl. No.: 402,750

[22] Filed: Jul. 28, 1982

[51] Int. Cl.[3] ..... B05D 3/02; D21H 1/40; D21H 1/48

[52] U.S. Cl. ..... 428/511; 162/136; 427/391; 427/439; 428/439

[58] Field of Search ..... 162/136, 197; 428/511, 428/514; 427/391, 439

[56] References Cited

U.S. PATENT DOCUMENTS

| | | | |
|---|---|---|---|
| 3,989,416 | 11/1976 | Louden | 427/361 |
| 4,058,648 | 11/1977 | Louden | 428/511 |
| 4,288,498 | 9/1981 | Scribner | 428/473 |

OTHER PUBLICATIONS

Paper Making and Paper Board Making, vol. III, Published by McGraw-Hill in 1970, pp. 407-418.

*Primary Examiner*—James C. Cannon
*Attorney, Agent, or Firm*—Howson and Howson

[57] ABSTRACT

A paper which resists significant distortion in planarity in response to moisture comprises a web which carries a predetermined amount of a polymer-filler blend and which has been dried after application of said blend to a finished moisture level below about 4%, by weight.

30 Claims, 2 Drawing Figures

FLAT PAPER AND METHOD OF MANUFACTURING INVOLVING CONTROLLED DRYING CONDITIONS

FIELD OF THE INVENTION

The present invention relates to paper, and more particularly, the present invention relates to paper which is flat when manufactured and which retains its flatness when subjected to moisture, and to a method of manufacturing such paper.

BACKGROUND OF THE INVENTION

It has long been known in the art that cellulose fibers used in the manufacture of paper and paperboard have a natural affinity for water even though they are water insoluble. It is this characteristic of cellulose fibers which makes possible the paper and paperboard manufacturing processes currently used. This water affinity has its advantages and disadvantages.

In forming paper or paperboard, the cellulose fibers are dispersed in a dilute aqueous slurry which is wet laid as a mat or web onto the screen of a conventional Fourdrinier-type machine. After the web has been dewatered, it is dried to a predetermined moisture level upstream of the size press, and after application of sizing or other treatment at the size press, the web is again dried to its finished condition. The drying process is known to affect the physical characteristics of the finished product, including its planarity, or flatness.

Even though the finished paper is dried, it always contains a certain amount of moisture. The amount of moisture will vary, depending upon the relative humidity to which the finished paper is subjected. Thus, except for a relatively narrow range of relative humidity conditions when the paper is in equilibrium with moisture in its ambient atmosphere, the paper is either taking on or giving off moisture. In other words, paper is hygroscopic.

Different papers have different degrees of hygroscopicity. In general, heavily refined fibers will absorb more moisture under the same relative humidity conditions than will less heavily refined fibers. In Volume III of *PAPER MAKING AND PAPER BOARD MAKING,* published by McGraw-Hill in 1970, the theory of drying is discussed, and the relationship between moisture content of various papers and ambient relative humidity is graphically illustrated. For instance, newsprint paper contains approximately 5% moisture at 50% relative humidity at 70° F. Under the same conditions of humidity and temperature, kraft paper contains almost 7% moisture.

As noted in the aforementioned publication, water may be present in paper in any one or more of several forms. For example, the water may be chemically or mechanically bound to the fibers as hygroscopic water. It may be contained within the fibers, located on the surfaces of the fibers, or entrapped in the voids of the fiber network. The water may be chemically bound by having entered into a hydration bond with the molecules of the cellulose fibers or with other substances in the web, such as water soluble sizing agents in the surfaces of these molecules.

Because paper and paperboard are hygroscopic, they are affected dimensionally by changes in moisture content, particularly during drying. This is because as moisture is evaporated from the web, the web tends to shrink. However, because the shrinkage does not occur evenly, the web may develop cockles, wrinkles and a general bagginess.

The addition of sizing agents to the web often exacerbates the sensitivity of the paper to moisture changes. This is because sizing agents often exhibit greater moisture sensitivity, i.e. a greater tendency to expand or contract in a response to changes in moisture, than the cellulosic fibers themselves. This phenomenon is particularly pronounced when the web is treated with starches, polyvinyl alcohols, carboxymethyl cellulose, methyl celluloses, and carboxylated celluloses such as kelgin, and the like. As a result, the thus-treated sheets often exhibit poorer planarity, or flatness, than untreated sheets.

Because the aforementioned planarity problems are known in the art, it is customary to dry the web during manufacture to a moisture level which is intended to place it in equilibrium with the average relative humidity to which the finished paper is likely to be subjected, generally accepted to be 50%. This is because if the web is overdried, it will acquire excessive moisture and hence expand excessively when exposed to average humidity conditions. When in roll form, moisture pick up causes expansion or rope marks to form in the outer layers of the rolls, and when the paper is in the form of a sheet, it tends to form undesirable cockles, wrinkles, and to exhibit a general bagginess. Hence, in order to compensate for these undesirable tendencies, paper is normally finish dried to a moisture content in a range of about 5% to about 6%, by weight, based on the weight of the finished paper.

It is known that there are occasions during manufacture when the paper web will have an uneven moisture profile in the cross-machine direction. These wet streaks, or other areas of high moisture content may exist even when the paper is finish dried to the 5–6% moisture range noted above. Some paper makers attempt to compensate for this uneven moisture profile by further reducing the finished moisture level, generally down to about 4%, to bring the variations in the moisture profile into an acceptable range. However, drying paper to this lower level is undesirable because it increases the brittleness of the paper. Moreover, finished moisture levels below about 5% are generally regarded as being undesirable because of the recognized proclivity of overdried papers to cockle, wrinkle and develop bagginess when the finished paper is subjected to relative humidity within anticipated ranges.

After manufacture, paper is often subjected to further treatment to impart various desirable properties, including moisture resistance, grease resistance, or heat sealing qualities. When these treatments are applied as a water-based coating on one side of the web, the paper will wrinkle or cockle more severely and develop more curl if the paper is too dry. In fact, any time paper is subjected to a moisture-containing treatment, either by way of coating or sizing, it is always difficult to keep the flatness of the final product within acceptable limits. For this reason, water-based coatings or treatments are often not used.

In some industrial applications for paper, the web may be subjected to heat in an oven, frequently for extended periods of time at elevated temperatures. Under these conditions, the paper will shrink and develop cockles. Sometimes, the paper will curl if the heat is applied unevenly. The paper also tends to become brittle. Furthermore, unless a controlled amount of moisture is again applied to the paper after leaving the oven, there is a tendency for the paper uncontrollably to reabsorb moisture and thereby lose the desired flatness.

Paper is sometimes laminated with plastic film or aluminum foil. However, if the paper is overdried prior to lamination, serious curl problems can develop. Often, reconditioning of the overdried paper is necessary before laminating, and even when these precautions are taken, inherent imbalance in the dimensional stability of the two components of the laminate tends to induce the laminate to curl in response to changes in relative humidity.

BRIEF DESCRIPTION OF THE PRIOR ART

The problem of providing a flat paper which retains its flatness over a wide range of moisture and humidity conditions has plagued the art for many years. Several techniques have been developed to solve the problem; however, each has its limitations.

The most universally used technique to produce flat paper involves drying the paper as uniformly and as gently as possible to minimize the development of interfiber stresses as the web is being dried. Every effort is made to avoid wet streaks, i.e. variations in the moisture profile in the cross-machine direction. Moreover, every effort is made also to dry the finished paper to within the conventionally accepted 5% to 6% moisture content range in order to place it in equilibrium with the 50% relative humidity target. The problems associated with this technique have been discussed above.

Another technique which has been proposed involves the selection of pulp to be used. It is known that papers comprising a high percentage of short fibered pulps tend to exhibit better flatness characteristics than papers fabricated of longer-fibered pulps. Furthermore, paper fabricated from fibers which have been de-inked tends to yield finished papers having desirable flatness.

Some degree of flatness control can be obtained by carefully controlling the amount of refining to which the pulp is subjected. Generally, refining should be kept to a minimum compatible with other performance specifications of the paper. This, however, is difficult because refining to control flatness is frequently at great odds with respect to refining required to produce other performance characteristics, particularly with respect to dense papers.

A further technique which has been used to improve the flatness of paper is for a moisture proof coating, such as a polyethylene film or the like, to be applied to both sides of the paper web. The coating prevents moisture from be given off or taken on except over very great lengths of time. While this technique can produce a paper having a high degree of flatness, it results in a basic change in the nature of the paper. Moreover, this technique is relatively expensive and not well suited to the manufacture of lightweight papers.

Louden U.S. Pat. Nos. 3,989,416 and 4,058,648 disclose a process for producing a dense paper having certain desirable characteristics, including erasability, ink, oil and solvent (including silicone polymer) holdout characteristics, folding endurance, stiffness, and abrasion resistance. Copending Louden U.S. patent application Ser. No. 297,104, filed on Aug. 28, 1981 for Erasable Dense Paper and Improved Method of Manufacturing discloses certain improvements in the aforementioned paper and manufacturing method. The improvements are realized by adding small amounts of an organic compound of tin during manufacture to enhance erasability and to facilitate manufacture.

OBJECTS OF THE INVENTION

With the foregoing in mind, a primary object of the present invention is to produce a novel paper which is characterized by improved planarity, or flatness, i.e. by a resistance to wrinkling and curling over a wide range of moisture conditions.

Another object of the present invention is to provide an improved paper which resists wrinkling, curling and the like even when subjected to water and which, therefore, is particularly suited for post-manufacturing processing utilizing water-based treatments.

A still further object of the present invention is to provide a unique process for manufacturing a dimensionally stable paper on conventional paper manufacturing machinery.

Another object of the present invention is to provide a paper manufacturing method which is an improvement over the paper manufacturing technology disclosed in the aforementioned Louden patents.

SUMMARY OF THE INVENTION

More specifically, the present invention provides an improved paper which is resistant to wrinkling, curling and the like, over a wide range of moisture conditions. The paper comprises a web of cellulosic fibers which has been treated to carry on opposite surfaces a polymeric material constituting at least about 3%, by weight, of the finished dry weight of the paper. Preferably, the polymeric material is extended with an inorganic filler in a stated weight percentage range. The thus-treated web is dried to reduce its finished moisture level to below about 4%, and more preferably, to a moisture level in a range of 1% to 2%, by weight, based on the finished dry weight of the paper. The resulting paper is characterized by a mean flatness or planarity of less than 10 millimeters measured at spaced locations in a plane overlying a sheet of the paper having been subjected to the planarity test procedure disclosed herein.

BRIEF DESCRIPTION OF THE DRAWINGS

The foregoing and other objects, features and advantages of the present invention should become apparent from the following description when taken in conjunction with the accompanying drawing, in which.

Figure 1:
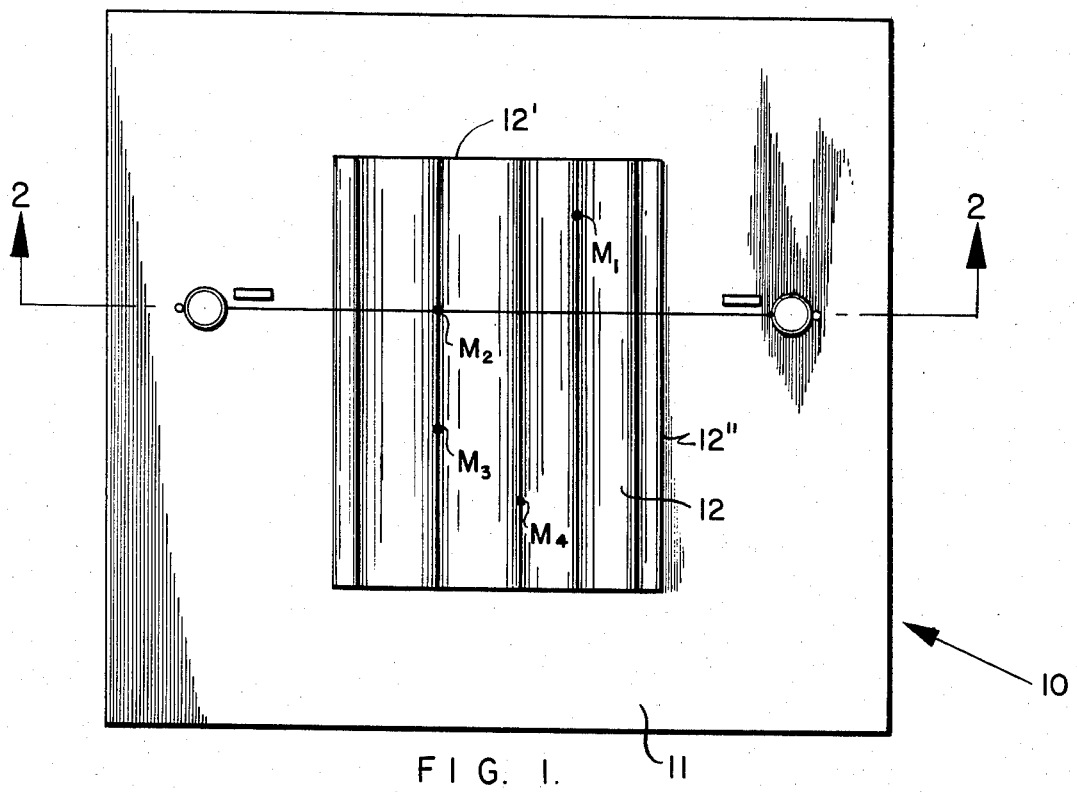
FIG. 1 is a plan view of apparatus for measuring the flatness of paper manufactured in accordance with the present invention.

DESCRIPTION OF THE PREFERRED PROCESS FOR MANUFACTURING THE PAPER OF THE PRESENT INVENTION

In producing paper, a web of cellulosic fibers is wet laid on a moving screen, and after the web has been dewatered and become coherent, it is dried to a predetermined moisture level prior to passing through a size press where sizing or other treatments may be applied. The web is usually dried to a moisture level of about 5%, by weight, at this stage of manufacture. After application of the treatment, the web is heated to evaporate moisture picked-up as a result of the treatment. Customarily, depending upon the nature of the pulp, the web is finish dried at this stage of manufacture to a finished moisture level in a range of 2-5% to minimize distortions in response to post-manufacturing changes in relative humidity. In spite of efforts to overcome dimensional instability and flatness problems, a commercially satisfactory method of producing a relatively moisture-insensitive paper on conventional paper making machinery has not been known.

The present invention provides a method whereby a paper having extraordinary flatness, or planarity, over a wide range of moisture conditions can be manufactured economically on conventional paper making machinery. To this end, the paper of the present invention is manufactured on a conventional paper making machine having an upstream dryer section, a size press, a downstream dryer section, and a take up reel. As will be discussed, a predetermined amount of a treatment is applied to both sides of the upstream-dried web at the size press, and thereafter, the thus-treated web is heated in the downstream dryer to a temperature sufficient to reduce the moisture content of the finished paper below a prescribed value which has been determined to be about 4%, by weight, based on the finished dry weight of the paper. Preferably, the web is finish dried to a moisture level in a range of about 1% to about 2%, by weight, based on the weight of the dry finished paper. With the use of modern sensing devices, the measurements of moisture level are made simultaneously with the manufacture of the paper as the web is advancing.

The resulting paper is characterized by planarity, or flatness, i.e., by a tendency to remain flat and resistant to curling, cockling, and the like even when subjected to high ambient relative humidity conditions and post-manufacturing water-based treatment solutions. As measured by a test disclosed herein, (hereinafter called "planarity test") the paper of the present invention is characterized by a mean flatness, or planarity, of less than 10 millimeters measured at spaced locations in a plane overlying a sheet of the paper when supported on a flat surface after having been wet with water and dried.

As will be discussed, drying of the web to a predetermined minimum moisture level, after having been treated with a polymeric material, is critical in the manufacture of the paper of the present invention. This is because unless the paper web has been dried to below about 4%, the aforementioned desirable planarity characteristics are not realized. Of course, other important factors in the manufacture of a satisfactory dimensionally stable paper include the percentage of the polymeric material carried by the web and the extent to which the polymeric material may be extended with an inorganic filler.

The paper disclosed in Louden U.S. Pat. Nos. 3,989,416 and 4,058,648 is characterized by good erasing qualities, improved ink, oil, silicone and solvent hold-out properties, improved abrasion resistance, and improved folding endurance. In manufacturing paper according to these patents, a web of cellulosic fibers having an uncalendered dry density in a range of about 7–11 pounds per mil. is impregnated with an aqueous dispersion of a rigid polymeric material and a mineral filler blended together in stated proportions. The paper, after impregnation, comprises from about 8½ to about 50%, by weight, of the impregnant, based on the dry weight of the finished paper. The impregnant includes from about 35% to about 90% of the rigid polymeric material and from about 10% to about 65% of the inorganic filler. The rigid polymeric material has a glass transition temperature ($T_g$) in a range of about 15° to about 60° C. The percentages of the polymeric material and filler are by weight based on the weight of the impregnant.

In the aforementioned Louden patents, the disclosures of which are incorporated by reference herein, dense papers having certain desirable characteristics are produced. However, since the papers of those patents are not dried in the manner disclosed and claimed herein, they do not possess the exceptional planarity characteristics of paper produced in accordance with the present invention. If, however, the process disclosed in U.S. Pat. No. 3,989,416 were modified so that the treated web was finish dried to a moisture level below about 4%, the resulting paper would possess exceptional planarity in addition to the fine erasing, hold-out, abrasion resistance, and folding qualities of the papers disclosed in those Louden patents.

In the aforementioned Louden patents, the cellulosic fiber web is impregnated with the polymer-filler blend at the size press. Impregnation is effected by applying the impregnant as an aqueous dispersion to both sides of the web. Depending upon various factors, such as web density, solids content of the dispersion, and machine speed, the depth of penetration of the web varies. While complete penetration is preferred, certain beneficial results of the present invention can be obtained by uniformly distributing the treatment as a coating on the web and thereby carrying the treatment blend primarily on both sides of the web rather than uniformly distributing the treatment completely throughout the web. In the present invention, the cellulosic fiber web should have a pretreatment density in a range of about 7.0 to about 14.0 pounds per mil. (lbs./mil.), determined by dividing the basis weight of the paper (500 sheets 24×36 inches) by the caliper of an uncalendered sheet.

The treated web should carry at least about 3% but less than about 50%, by weight, of the treatment blend which, as noted heretofore, desirably, but not necessarily, may include an inorganic or mineral extender or filler. More preferably, the finished paper carries at least about 5% of the treatment, and most preferably, the paper carries from about 10% to about 18% of the treatment. The percentages are by weight, based on the finished dry weight of the paper. By dry weight is meant the weight of the paper after conditioning for at least 24 hours after having been manufactured.

While the desired planarity can be obtained without utilizing a filler in the treatment, if the resulting paper is to possess tear resistance and folding endurance in addition to planarity, the treatment should include both a polymeric material and a mineral extender or filler. To this end, the treatment may include up to about 65% of a finely divided or powdered mineral such as clay, calcium carbonate, talc, or mica. More preferably, the treatment includes in a range of about 40% to about 60% of the mineral powder. The percentages of the mineral powder component of the treatment blend are by weight, based on the dry weight of the treatment blend.

The polymeric material utilized in the present invention is preferably rigid, i.e., it should have a glass transition temperature ($T_g$) of at least about 15° C. However, it has been determined that dimensional stability can be realized using polymers having glass transition temperatures as low as −36° C. for those applications in which flatness alone is of paramount importance. Preferred polymers have glass transition temperatures in a range of about 15° C. to about 70° C.

Several different polymeric materials have been tested and found satisfactory in producing the paper of the present invention. For example, preferred polymeric materials include: polyvinyl acetate, polyacrylate, polyvinyl chloride, and mixtures thereof. One preferred polyvinyl acetate is Vinac 881 manufactured by Air Products and Chemical Company of Allentown, Pa. A preferred polyacrylate is Rhoplex AC-201 manufactured by Rohm and Haas Company of Philadelphia, Pa. A preferred polyvinyl chloride is Geon 352 manufactured by B. F. Goodrich Chemical Company of Cleveland, Ohio. The $T_g$ of Vinac 881 is 31° C.; the $T_g$ of Rhoplex AC-201 is 29° C.; and the $T_g$ of Geon 352 is 69° C.

While a rigid polymeric material is preferred, and by rigid is meant having a $T_g$ of at least about 15° C., some benefit in dimensional stability may be achieved using a less rigid polymer. For example, Rohm and Haas Rhoplex B-15 polyacrylate having a $T_g$ of 0° C. provides a desirable amount of flatness, and polyvinyl acetate sold by National Starch and Chemical Company of Bridgewater, N.J. under the trade designation Resyn 2873 having a $T_g$ of −36° C. also provides a desirable amount of flatness.

The treatment formulation comprises a blend of polymeric material and a mineral filler or extender. As discussed in the aforementioned Louden patents, several different mineral extenders may be used effectively, including delaminated clay manufactured by J. M. Huber Corporation, Huber, Ga., calcium carbonate sold under the trade designation Camelwite by Charles T. Campbell Company, Towson, Md., talc sold under the trade designation Mistron Vapor by the United Sierra Division, Cypress Mines, Trenton, N. J. and mica sold under the trade designation Davenite Mica by the Hayden Mica Company, Wilmington, Mass.

In order to evaluate the planarity of paper manufactured in accordance with the present invention a test procedure has been developed. The test procedure, intended to measure the planarity or flatness of sheets of paper, is referred to hereinafter as the planarity test procedure. The planarity test procedure includes a planarity measuring step, preferably performed in the test apparatus illustrated in FIGS. 1 and 2.

Referring now to the drawings, the planarity measuring apparatus 10 comprises a planar surface or platen 11 adapted to support a sheet of paper 12of $8\frac{1}{2}\times 11$ inch letter size dimensions. The platen 11 is provided with a pair of bores 11*a* and 11*b* which slidably receive a pair of elongated dowels 13 and 14 and which mount the dowels for vertical movement in the directions indicated by the arrows in FIG. 2. A fine strand or wire 15 is stretched taut between the dowels 13 and 14, extending in a straight line therebetween as indicated in FIG. 1. A pair of rules 16 and 17 are mounted to the platen 11 adjacent the dowels 13 and 14 and the strand 15 in the manner illustrated in FIG. 2. Preferably, the rules 16 and 17 are graduated in millimeters and are disposed in such a manner as to enable a technician to determine the distance the strand 15 is located above the top surface 11' of the platen 11 and to position the strand parallel to the surface 11'. Preferably, legs 18 and 19 are provided to support the platen 11 above a work surface 20 in such a manner as to enable the dowels 13 and 14 to be raised and lowered readily.

Figure 2:
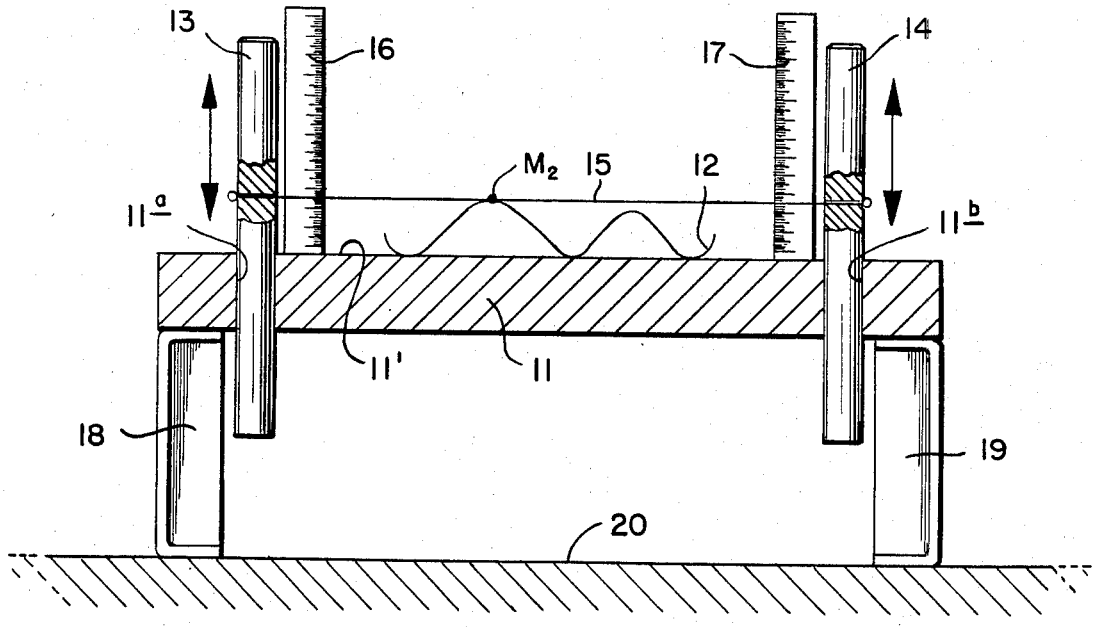
FIG. 2 is a sectional view of the apparatus taken on line 2—2 of FIG. 1.

In measuring planarity, a sheet of paper, such as the sheet 12 is laid flat on the platen 11 with any observable curl being disposed upwardly in the manner illustrated in a greatly exaggerated manner in FIG. 2. The dowels 13 and 14 are then lowered until the strand 15 contacts the sheet 12 at its highest point $M_2$ and the strand 15 is disposed parallel to the upper surface 11' of the platen 11. The distance of the strand from the upper surface 11' is noted. Several measurements like this are taken at various spaced locations above the sheet in both the machine direction (lengthwise of the sheet) and in the cross-machine direction (widthwise of the sheet). For instance, measurements taken in the cross-machine direction are taken by contacting the strand 15 with the sheet 12 disposed in the manner illustrated in FIG. 1 at four spaced locations, such as the locations $M_1$–$M_4$ located 2, $4\frac{1}{4}$, $6\frac{1}{2}$, and $8\frac{3}{4}$ inches from the upper edge 12' of the sheet 12. Each measurement is recorded. Thereafter, the sheet 12 is turned 90° and similar measurements are taken in the machine direction at distances of $1\frac{1}{2}$, $3\frac{1}{4}$, 5 and $6\frac{3}{4}$ inches from the right-hand edge 12'' of the sheet 12. The resulting measurements are averaged to produce a mean value, i.e. mean planarity, in millimeters which value is an indication of planarity. For instance, a perfectly flat sheet would have a mean planarity corresponding to the thickness of the sheet itself which, in most cases, would be about 0.3 millimeters. Thus, it should be apparent that the larger the average or mean planarity measurement, the poorer the relative flatness or planarity of the sheet.

Various papers have been designed with various specific end uses in mind. For example post-manufacturing water-based treatments may be applied to one, or the other, or both sides of paper to provide heat sealing properties, moisture barrier properties, vapor barrier properties, or solvent barrier properties. Ready release properties may be imparted by applying silicones and curing the same. Moreover, some applications involve the coating of water-based pressure sensitive adhesives onto the paper and subsequent expulsion of the moisture from the paper. However, in each of these applications, care must be taken in the manufacture of the paper and in the application of these coatings in order to prevent cockles, wrinkles or bagginess from being induced in the finished paper. Thus, while each paper has its advantages, each also has its disadvantages, particularly when it comes to retaining planarity after having been subjected to water.

For the purpose of demonstrating the operation of the apparatus 10 in the planarity test procedure, as well as to provide some indication as to the relative planarity of various types of paper, several different sheets of paper were prepared and tested. The sheets were tested to demonstrate the relative tendency of different papers to act in a hygroscopic manner to absorb moisture.

In the planarity test procedure, six different sheets of paper $8\frac{1}{2}$ inches$\times$11 inches in size were dipped (grain long) into water for approximately 30 seconds, and each was then passed through rubber squeeze rolls to remove excess water. Each sample was then placed between two sheets of commercial paper toweling and pressed by hand to remove surface moisture. Each test sample was then placed in a standard Williams laboratory paper sheet dryer wherein the sample is held tightly against a curved metal surface of approximately the curvature of a dryer cylinder. The temperature of the surface of the dryer was maintained at 180° F. A canvas felt was utilized to hold the sample tight against the dryer surface. The drying time for each sample was 30 seconds for each side, the sample being turned to dry both sides. After drying, each specimen was permitted to recondition for 24 hours at room temperature (70°-75° F.) at a relative humidity in a range of about 30% to about 50% lying flat on a surface. The purpose of testing paper in this manner is to provide a single reliable, and reproducible procedure for observing, on an accelerated basis, the effects of moisture on paper.

EXAMPLE I

By way of comparison, six sheets of various types of paper were subjected to the aforementioned planarity test procedure, after having been dipped in water, subsequently dried, and allowed to condition for 24 hours before their planarity was measured. The results of the planarity test procedure are reflected in the planarity measurements set forth below in TABLE I wherein the term average measurement corresponds with the term mean planarity used herein.

TABLE I

Comparison of Planarity of Various Papers

| Sample | Usage | Average Measurement (mm) |
|---|---|---|
| A | Unsized, 35.8 lb.* (Standard Treating Base) 60% northern softwood kraft 40% northern hardwood kraft | 28.3 |
| B | 35 lb.* for emulsion silicone coating | 30.7 |
| C | 30 lb.* for polyvinylidine latex coating | 17.3 |
| D | 42 lb.* supercalendared kraft for solvent silicone coating | 15.7 |
| E | 30 lb.* printing paper, uncoated | 17.4 |
| F | 37 lb.* prepared for maximum flatness, slow speed low temperature drying, high percentage hardwood pulp | 8.6 |

*(basis weight - 24 × 36 inches - 500 sheets)

From the foregoing table, it may be seen that of the of various types of paper, the paper which exhibited the greatest planarity was sample F. This paper, however, was prepared with a large percentage of short fibered hardwood pulp, and the paper making machine was run at a relatively slow speed (300 feet per minute) with gentle drying. Each of the other sheets of paper exhibited significantly less planarity, indicating the adverse affect on the papers of water such as may be present in a water-based post-manufacturing treatment. Thus, from the foregoing, it should be apparent that a commercially desirable paper suitable for receiving water-based post-manufacturing treatments should have an average planarity below about 10 millimeters corresponding approximately to the planarity of sample F in TABLE I.

According to the present invention, it has been found that a paper web having been treated with the polymeric formulations noted heretofore, and having been dried, after treatment, to a moisture level below about 4%, exhibits the desired degree of mean planarity, which is below about 10 millimeters. Moreover, it has been determined that the desired degree of planarity is retained by the finished paper even though it may be subjected to water-based post-manufacturing treatments and/or high relative humidity conditions.

EXAMPLE II

In order to demonstrate the criticality of the drying step in making paper according to the present invention, several specimens of the Standard Treating Base paper (sample A, Example I) were prepared for comparison testing. One group of specimens was subjected to a water only treatment; the other group of specimens was subjected to an extended polymer treatment formulation. The specimens were dried to various moisture levels and subjected to the planarity test procedure discussed heretofore.

More specifically, the extended polymer treating formulation was prepared by weighing 64 grams of water into a beaker equipped with a high speed laboratory stirrer. Gradually, and with good agitation, 36 parts of Hydroprint delaminated clay was added to the water. Thereafter, 50 parts of Vinac 881 polyvinyl acetate emulsion (48% solids) was added with mild stirring. The pH was adjusted to 10 with ammonia. The resulting extended polymer treatment blend had a solids content of 40%.

In the first group of specimens, sheets of the Standard Treating Base paper noted heretofore, i.e., unsized paper having a 35.8 lbs. basis weight, were dipped into the above-prepared treatment formulation. Excess treatment was removed by passing each sheet between rubber squeeze rolls and thereafter briefly sandwiching the sheet between two commercial paper towels to remove excess moisture. The sheet was then placed in the Williams sheet dryer, the temperature of which was maintained at 180° F. Each sheet was dried for a different length of time so that the moisture content of each sheet differed. Each sheet was allowed to condition for 24 hours under the temperature and humidity conditions noted heretofore in Example I.

The above procedure was repeated with respect to the second group of specimens, except that plain water was used as the treating solution rather than the extended polymer blend.

With both groups of specimens, as soon as each sheet was removed from the dryer, it was immediately placed in a previously weighed plastic bag, and the bag and paper were weighed together. Thereafter, the sheet was removed from the bag and placed in a laboratory oven and dried for two minutes at 300° F. to remove all the moisture. Immediately thereafter, the sheet was placed in the plastic bag and reweighed. The difference in weight represented the moisture driven off in the oven. Thus, each test sheet was dried for a different amount of time, and the finished moisture content was measured.

Each sheet was later tested for planarity in accordance with the planarity test procedure in order to determine the combined effect of the prepared treatment solution and the drying level on planarity. The results of the tests may be seen in the planarity measurements set forth below in TABLE II.

TABLE II

Comparison of Planarity of Water Treated Sheets With Extended Polymer Treated Sheets

| Mean Planarity (mm) Standard Treating Base Treated With Water and Dried | Finished Sheet Moisture Content | Mean Planarity (mm) Standard Treating Base Treated With Polyvinyl Acetate-Clay And Dried |
|---|---|---|
| — | 9.7% | 15.4 |
| 13.4 | 6.6% | — |
| — | 5.8% | 13.8 |
| 11.9 | 5.6% | — |
| — | 4.6% | 14.2 |
| — | 3.8% | 10.0 |
| 20.8 | 3.6% | — |
| — | 3.3% | 8.5 |
| — | 2.8% | 8.6 |
| — | 2.7% | 7.5 |
| — | 2.2% | 7.8 |
| — | 1.7% | 5.9 |

TABLE II-continued

| Comparison of Planarity of Water Treated Sheets With Extended Polymer Treated Sheets | | |
|---|---|---|
| Mean Planarity (mm) Standard Treating Base Treated With Water and Dried | Finished Sheet Moisture Content | Mean Planarity (mm) Standard Treating Base Treated With Polyvinyl Acetate-Clay And Dried |
| 28.3 | 1.2% | — |

From the above data, it may be observed that of those sheets which were treated with water only, the optimum planarity occurred in finished paper having a 5.6% to 6.6% final moisture content out of the dryer. Quite unexpectedly, however, a totally different result is achieved when the sheets are treated with the extended polymer blend. With those sheets, planarity improvement is not realized until the final moisture content of the finished paper is reduced below about 4%. Optimum planarity is achieved when the moisture level is reduced to a range of about 1 to about 2%. Compare the low levels of measured planarity of the extended polymer treated sheets with the water only treated sheets below the 4.6% moisture level.

EXAMPLE III

In the test performed in Example II, the extended-polymer blend was suspended in a aqueous carrier to provide a treatment formulation containing 40% solids by weight. In order to determine the lower limit of the solids content capable of providing a satisfactory paper in accordance with the present invention, the same extended-polymer blend was diluted with water to provide treating formulations having 40, 30, 25, 20, 15 and 10% solids. As in Example II, the same Standard Treating Base paper sheets were treated with each formulation; the sheets were weighed before and after treatment and drying to determine the amount of treatment carried by each sheet. The sheets were then subjected to the aforementioned planarity test procedure after having been conditioned for 24 hours in the manner described heretofore in Example I. The results are set forth below in TABLE III.

TABLE III

| Comparison of Planarity With Amount of Extended Polymer Treatment | | |
|---|---|---|
| Percent Treatment in Sheet* | Percent Solids in Treatment Formulation** | Mean Planarity (mm.) |
| 0.0 | 0 | 28.3 |
| 2.7 | 10 | 19.5 |
| 5.3 | 15 | 9.6 |
| 8.9 | 20 | 8.0 |
| 10.0 | 25 | 6.3 |
| 11.8 | 30 | 6.8 |
| 17.8 | 40 | 4.8 |

*dry solids, finished weight basis
**dry solids weight

From the above data, it may be observed that significant improvement in planarity begins to occur when the paper contains a treatment solids content above about 5%, by weight, based on the finished dry weight of the paper, corresponding to a treatment formulation solids content of at least 15%. The more preferred range of solids content, however, is between about 10% and about 18% on the same weight basis, corresponding to a treatment formulation solids content of 25% to 40%. By dry weight is meant the weight of the solids with all moisture removed and the weight of the paper with all moisture removed.

EXAMPLE IV

The polymer may be extended with a mineral filler up to about 65% of the weight of the polymer-filler blend on a dry solids basis. Extension beyond this limit results in a degradation in planarity. The optimum amount of extension is about 10%. However, as noted heretofore, substantial planarity benefits can be achieved without any mineral extender present if higher costs are of less concern to the paper manufacturer.

The effects of extension of the polymeric material with a filler may be observed from the following test data. In this test, five different treatment formulations were prepared, each having a different amount of extender or filler which, in this example, is the Hydroprint clay described heretofore. The pH in each formulation was adjusted to 10 with ammonia. Each sheet of the Standard Treating Base paper was treated on both sides with the formulation in the manner noted in Example I, and each sheet was dried at 180° F. for 30 seconds on each side in the same manner. The results are set forth below in TABLE IV.

TABLE IV

| Effect of Various Amounts of Polymer Extension on Sheet Planarity | | | | |
|---|---|---|---|---|
| Formulation | Composition (wt, g) | | Percent Extension | Planarity (mm) |
| 1 | Vinac 881 | 50 | | |
| | Water | 10 | 0 | 4.9 |
| 2 | Vinac 881 | 50 | | |
| | Clay | 2.7 | | |
| | Water | 14 | 10 | 4.5 |
| 3 | Vinac 881 | 50 | | |
| | Clay | 36 | | |
| | Water | 64 | 60 | 5.8 |
| 4 | Vinac 881 | 50 | | |
| | Clay | 44.6 | | |
| | Water | 76.9 | 65 | 6.8 |
| 5 | Vinac 881 | 50 | | |
| | Clay | 56 | | |
| | Water | 94 | 70 | 15.7 |

From the above data, it may be seen that the treatment formulation may be extended with clay up to about 65% of the weight of the formulation, based on the weight of the solids in the formulation. Above this limit, planarity decreases rapidly and significantly.

EXAMPLE V

Several different types of rigid polymeric binders may be used satisfactorily in manufacturing paper in accordance with the present invention. To demonstrate the efficacy of the several preferred rigid polymeric material binders disclosed, a test was conducted wherein three formulations were prepared each containing clay, water and a polymer in about the same proportions. The pH of each of the formulations was adjusted to 10. The Standard Treating Base paper was tested in accordance with the planarity test procedures outlined in Example I. The results of this test are set forth below in TABLE V.

TABLE V

| Effect of Various Polymeric Materials on Planarity | | |
|---|---|---|
| Chemical Composition of Binder | Glass Transition Temperature ($T_g$) °C. | Mean Planarity |
| Polyvinyl Acetate (Vinac 881) | +31 | 5.9 |

TABLE V-continued

| Effect of Various Polymeric Materials on Planarity | | |
|---|---|---|
| Chemical Composition of Binder | Glass Transition Temperature ($T_g$) °C. | Mean Planarity |
| Polyacrylate (Rhoplex AC-201) | +29 | 9.2 |
| Polyvinyl Chloride (Geon 352) | +69 | 7.1 |

The above data indicates that each of the three types of rigid polymers tested provides the desired degree of planarity in the finished sheet.

EXAMPLE VI

The polymers utilized in the manufacture of paper according to the present invention should be rigid, i.e., should have a glass transition temperature ($T_g$) of at least about 15° C. While less rigid polymers provide some improvements in planarity, the more rigid polymers are clearly preferred. In order to demonstrate the effect of polymer rigidity on planarity, a test was conducted utilizing a treating formulation prepared in accordance with Example I, except that a variety of different polymeric materials were substituted for the Vinac 881 polyvinyl acetate used therein. The solids content of each formulation was maintained at 40% so that the same proportions existed in all cases. The differences in the rigidity of the polymer is indicated by its glass transition temperature. The same planarity testing procedure, as well as the base paper used in Example I, was used in this test. The results are set forth below in TABLE VI.

TABLE VI

| Effect of Polymer Rigidity on Planarity | | |
|---|---|---|
| Polymer Type | (°C.) | Planarity (mm) |
| Polyacrylate Rhoplex AC-201 | +29 | 8.8 |
| Polyacrylate Rhoplex B-15 | 0 | 11.2 |
| Polyacrylate Rhoplex E-491 | less than 0 | 9.4 |
| Polyvinyl Acetate Vinac 881 | +31 | 5.8 |
| Polyvinyl Acetate Resyn 2873 | −36 | 9.2 |

The above data indicates that while some planarity benefits may be realized using a polymer having a glass transition temperature of 0° C. and below, better planarity results are achieved using polymers having glass transition temperatures greater than about 30° C.

EXAMPLE VII

Various types of mineral fillers or extenders may be used satisfactorily in producing paper in accordance with the present invention. To demonstrate the interchangeability of several of the disclosed mineral extenders, a test was conducted wherein all the variables were fixed except the nature of the mineral extender. In the test, a treating formulation was prepared, as described in Example I, comprising 64 parts of water, 36 parts of clay and 50 parts of Vinac 881 polyvinyl acetate emulsion. The pH was adjusted to 10 with ammonia. The solids content of the formulation was 40% on a weight basis. The mineral extender constituted 60% of the solids content. The sheets were treated and tested in the same manner as in the preceding examples. The results of the test are set forth below in TABLE VII.

TABLE VII

| Effect of Various Extenders on Planarity | |
|---|---|
| Extender | Planarity (mm) |
| Clay | 6.6 |
| Calcium Carbonate | 5.6 |
| Talc | 6.5 |
| Mica | 6.2 |

Clearly, therefore, various extenders or pigments may be used with substantially the same affect on planarity.

In view of the foregoing, it should be apparent that the present invention now provides an improved process for manufacturing a paper having improved planarity characteristics. The paper is resistant to curling, cockling, wrinkling, and the like and is, therefore, particularly well suited for use in those applications where a post-manufacturing water-based treatment is applied to one or both sides thereof. Moreover, sheets of the paper are resistant to changes in flatness in response to variations in ambient relative humidity.

While a preferred process and paper have been described in detail, various modifications, alterations and changes may be made without departing from the spirit and scope of the present invention as defined in the appended claims.

We claim:

1. A paper manufactured in a continuous process on a conventional paper making machine having a downstream dryer section, said paper, comprising: a web of cellulosic fibers and a polymeric material carried by the web, said paper comprising not less than about 3%, by weight, of said polymeric material, said weight being based on the finished dry weight of the paper, said finished paper having been dried in said dryer section to a moisture content in a range of 1% to about 4%, by weight, based on the finished weight of said paper.

2. The paper according to claim 1 including an inorganic filler mixed with said polymeric material to form a blend distributed substantially uniformly on opposite sides of the web, said blend constituting less than about 50%, by weight, of the finished dry weight of the paper and said blend comprising at least about 35% of said polymeric material and less than about 65% of said inorganic filler.

3. The paper according to claim 2 wherein said polymeric material has a glass transition temperature in excess of −35° C. and includes at least one of the following: polyvinyl chloride, polyvinyl acetate and polyacrylate, and said inorganic filler includes at least one of the following: clay, calcium carbonate, talc and mica.

4. A paper manufactured in a continuous process on a conventional paper making machine, comprising: a web of cellulosic fibers carrying at least on opposite surfaces a uniformly applied treatment of a polymeric material constituting at least about 3%, by weight, of the finished dry weight of the paper, said web having been dried in said machine, after application therein of said treatment, to a moisture level in a range of 1% to about 4%, by weight, based on the finished dry weight of the paper, whereby the paper is characterized by a tendency to remain flat over a wide range of moisture conditions.

5. The paper according to claim 4 including an inorganic filler mixed with said polymeric material to form a blend distributed substantially uniformly on opposite sides of the web, said blend constituting less than about 50%, by weight, of the finished dry weight of the paper and said blend comprising at least about 35% of said polymeric material and less than about 65% of said inorganic filler.

6. The paper according to claim 5 wherein said polymeric material has a glass transition temperature in excess of −35° C. and includes at least one of the following: polyvinyl chloride, polyvinyl acetate and polyacrylate, and said inorganic filler includes at least one of the following: clay, calcium carbonate, talc and mica.

7. A paper manufactured in a continuous process in a conventional paper making machine, comprising: a cellulosic fiber web carrying at least on its opposite surfaces a blend of a polymeric material and an inorganic filler, said paper comprising from about 3% to about 50%, by weight, of said blend based on the finished dry weight of the paper, said blend including at least about 35% of said polymeric material and less than about 65% of said inorganic filler, said polymeric material and filler percentages being by weight based on the weight of the blend, said web having been dried in said machine after application of said blend thereto to a web moisture level above 1% but below about 4%, by weight, based on the dry finished weight of the paper.

8. The paper according to claim 7 wherein said polymeric material has a glass transition temperature ($T_g$) of at least about −35° C.

9. The paper according to claim 8 wherein said glass transition temperature ($T_g$) is greater than about 15° C.

10. The paper according to claim 7 wherein said polymeric material includes at least one of the following: polyvinyl acetate, polyacrylate and polyvinyl chloride.

11. The paper according to claim 7 wherein said mineral filler includes at least one of the following: clay, calcium carbonate, talc and mica.

12. The paper according to claim 7 wherein said paper comprises from about 10% to about 18%, by weight, of said blend.

13. The paper according to claim 7 wherein said web has a density prior to treatment with said blend in a range of about 7.0 to about 14.0 lbs./mil.

14. The paper according to claim 7 wherein said blend is impregnated in said web and is distributed throughout substantially the entire thickness thereof.

15. The paper according to claim 7 wherein said blend is substantially uniformly distributed on opposite surfaces of said web.

16. The paper according to claim 7 wherein said web has been dried to a moisture level in a range of about 1% to about 2% on said weight basis.

17. The paper according to claim 7 wherein said blend includes about 60%, by weight, of said inorganic filler.

18. The paper according to claim 7 wherein said blend comprises from about 35% to about 100% of said polymeric material and from about 0% to about 65% of said inorganic filler.

19. A method of manufacturing paper on a conventional paper making machine having a downstream dryer section, comprising the steps of:

forming a web of cellulosic fibers, advancing said web in said machine, applying to both sides of said web as it advances an aqueous dispersion including a polymeric material in an amount sufficient to constitute atleast about 3%, by weight, of the dry weight of the finished paper, and drying said advancing web in said downstream dryer section to a moisture level in a range of 1% to about 4%, by weight, based on the dry weight of the finished paper, whereby the finished paper is characterized by a flatness which tends to remain even after the paper has been subjected to moisture and redried.

20. The method according to claim 19 wherein, prior to application of said dispersion, said web has been dried to a moisture level below about 5%.

21. The method according to claim 19 wherein said dispersion includes an inorganic filler blended with said polymeric material.

22. The method according to claim 19 wherein said dispersion has a solids content of at least about 15%, by weight, based on the total weight of the dispersion.

23. The method according to claim 22 wherein said solids content is in a range of about 25% to about 40% on said total dispersion weight basis.

24. The method according to claim 19 wherein said web is dried to a moisture level in a range of about 1% to about 2% on said finished paper weight basis.

25. The method according to claim 19 wherein said polymeric material has a glass transition temperature in excess of about −35° C.

26. The method according to claim 19 wherein said polymeric material includes at least one of the following: polyvinyl acetate, polyacrylate and polyvinyl chloride.

27. The method according to claim 19 wherein said inorganic filler includes at least one of the following: clay, calcium carbonate, talc and mica.

28. The method according to claim 19 wherein said dispersion is applied at a size press in said conventional paper making machine.

29. The product manufactured in accordance with the method of claim 19.

30. The paper according to claim 7 wherein a sheet thereof is characterized by a mean planarity of less than about 10 millimeters measured in accordance with the planarity test procedure.

* * * * *